US011338595B2

(12) United States Patent
Mizusawa

(10) Patent No.: US 11,338,595 B2
(45) Date of Patent: May 24, 2022

(54) PRINT APPARATUS, METHOD FOR CONTROLLING THE SAME, AND STORAGE MEDIUM

(71) Applicant: SEIKO EPSON CORPORATION, Tokyo (JP)

(72) Inventor: Nobutada Mizusawa, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 17/031,005

(22) Filed: Sep. 24, 2020

(65) Prior Publication Data

US 2021/0094323 A1 Apr. 1, 2021

(30) Foreign Application Priority Data

Sep. 27, 2019 (JP) ..... JP2019-176764

(51) Int. Cl.

| | |
|---|---|
| ***B41J 11/00*** | (2006.01) |
| ***B41J 2/045*** | (2006.01) |
| ***B41J 2/21*** | (2006.01) |
| ***B41J 15/04*** | (2006.01) |
| ***B41J 29/38*** | (2006.01) |
| ***B41J 11/46*** | (2006.01) |
| ***B41J 29/393*** | (2006.01) |
| *B41J 2/01* | (2006.01) |

(52) U.S. Cl.

CPC ..... *B41J 11/008* (2013.01); *B41J 2/04505* (2013.01); *B41J 2/2146* (2013.01); *B41J 11/007* (2013.01); *B41J 11/46* (2013.01); *B41J 15/048* (2013.01); *B41J 29/38* (2013.01); *B41J 29/393* (2013.01); *B41J 2/01* (2013.01); *B41J 2029/3935* (2013.01)

(58) Field of Classification Search

CPC .... B41J 11/008; B41J 2/04505; B41J 11/007; B41J 2/2146; B41J 15/048; B41J 29/38; B41J 11/46; B41J 2/01; B41J 29/393; B41J 2029/3935

See application file for complete search history.

(56) References Cited

U.S. PATENT DOCUMENTS

2007/0024663 A1* 2/2007 Yamanobe ..... B41J 2/2135 347/19
2010/0277537 A1* 11/2010 Maekawara ..... B41J 11/007 347/16

FOREIGN PATENT DOCUMENTS

JP 2001-199055 7/2001

* cited by examiner

*Primary Examiner* — Henok D Legesse
(74) *Attorney, Agent, or Firm* — Workman Nydegger

(57) ABSTRACT

A printer includes an ink ejection unit configured to eject ink to a print medium, a transport belt on which the print medium is mounted, a driving section configured to transport the print medium by moving the transport belt, a specifying section configured to specify a print head to be adjusted using a test pattern, markers configured to indicate a position of the print medium when the test pattern is printed on the print medium, and a driving controller configured to control the driving section. The driving controller controls the driving section in accordance with the print head to be adjusted specified by the specifying section so as to adjust a position of the print medium.

9 Claims, 9 Drawing Sheets

PRINT APPARATUS, METHOD FOR CONTROLLING THE SAME, AND STORAGE MEDIUM

The present application is based on, and claims priority from JP Application Serial Number 2019-176764, filed Sep. 27, 2019, the disclosure of which is hereby incorporated by reference herein in its entirety.

BACKGROUND

1. Technical Field

The present disclosure relates to a print apparatus, a method for controlling the print apparatus, and a storage medium.

2. Related Art

In general, a method for performing adjustment associated with a print head by printing a test pattern using a print apparatus has been used (refer to JP-A-2001-199055, for example). JP-A-2001-199055 discloses a method for adjusting alignment of a head in a scanning direction by forming a test pattern using an image forming apparatus performing scanning with the head and ejecting ink so as to form an image on a medium. In this method, the alignment control is performed by optically reading line segments of a test pattern formed on a medium.

When adjustment of a printing head is performed, a medium different from a medium to be used by the print apparatus in normal printing may be used as a test medium for printing a test pattern. For example, a medium more suitable for reading the test pattern than a medium used for normal printing or a medium smaller than a medium used for normal printing may be used as a test medium. However, when the test medium is different from a medium to be used by a print apparatus for normal printing, a position of the test medium is required to be accurately positioned.

SUMMARY

According to an embodiment of the present disclosure, a print apparatus includes a print head ejecting ink to a print medium, a belt on which the print medium is mounted, a driving section configured to transport the print medium by moving the belt, a specifying section configured to specify the print head to be adjusted using a test pattern, a position indication section configured to instruct a position of the print medium when the test pattern is printed on the print medium, and a driving controller configured to control the driving section. The driving controller adjusts a position of the print medium by controlling the driving section relative to the print head to be adjusted specified by the specifying section.

A position of the print medium may be adjusted to a position corresponding to the print head. The test pattern may be printed even when a size of a print medium to be used in normal printing is not same as a size of a print medium to be used in printing of the test pattern.

The print apparatus may further includes a pattern detection section configured to detect the test pattern printed on the print medium. The driving controller may detect a shift of alignment of the print head based on a result of detection performed by the pattern detection section.

The alignment shift may be detected based on the test pattern.

The print apparatus may further include a plurality of print heads. The specifying section may specify a replaced head in the print heads as a print head to be adjusted.

In the print apparatus, the print head may be configured to perform printing on a first print medium for image printing and a second print medium which is the print medium on which the test pattern is to be printed and which is different from the first print medium. The driving controller may move the belt in a first direction so as to transport the first print medium when the print head prints an image on the first print medium. The belt may be moved in a second direction which is different from the first direction when the second print medium is moved to a position of the print head specified by the specifying section so that the test pattern is printed.

In the print apparatus, a position specified by the position indication section may be in a downstream of the print head in the first direction.

In the print apparatus, the second print apparatus may be a cut sheet of a regular size and a shift of alignment of the print head may be detected by optically reading the test pattern printed on the second print medium.

In the print apparatus, the belt may be processed in an endless shaped by coupling opposite sides of a long belt member, and the driving controller may move the belt before the print medium is mounted, when a joint section of the belt is positioned in a predetermined range from a position specified by the position indication section.

The print apparatus may further include a carriage configured to perform scanning in a direction intersecting with a movement direction of the belt, the print head being mounted on the carriage, and a distance detection section configured to be mounted on the carriage and detect a distance from a reference position to a surface of the belt. The driving controller may specify a region in which a flatness degree of the belt satisfies a set condition based on a result of detection performed by the distance detection section during scanning of the carriage.

According to another embodiment of the present disclosure, a method for controlling a print apparatus which includes a print head ejecting ink to a print medium and a belt on which the print medium is mounted and which transports the print medium by moving the belt includes moving, when the print head to be adjusted using a test pattern is specified, the belt in accordance with the specified print head to be adjusted so that a position of the print medium is adjusted.

According to a further embodiment of the present disclosure, a non-transitory computer-readable storage medium storing a control program to be executed by a controller controlling a print apparatus which includes a print head ejecting ink to a print medium and a belt on which the print medium is mounted and which transports the print medium by moving the belt, executes moving, when the print head to be adjusted using a test pattern is specified, the belt in accordance with the specified print head to be adjusted so that a position of the print medium is adjusted.

DESCRIPTION OF EXEMPLARY EMBODIMENTS

First Embodiment

Figure 1:
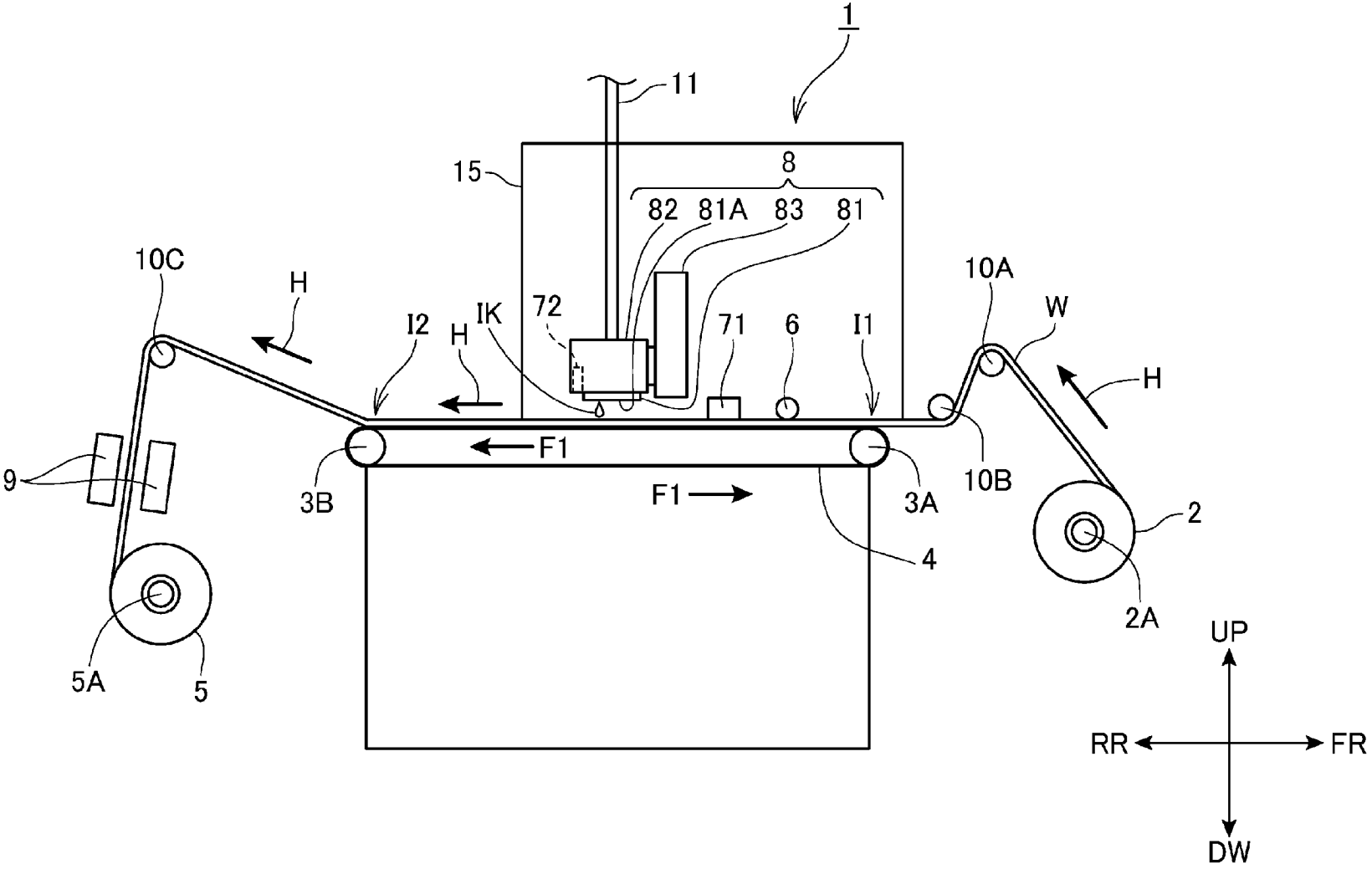
FIG. 1 is a diagram schematically illustrating a configuration of a printer.

FIG. 1 is a diagram schematically illustrating a configuration of a printer 1 as an example of a print apparatus of the present disclosure.

In FIG. 1 and the other drawings described below, a front portion in an installation state of the printer 1 is denoted by a reference symbol FR and a rear portion of the printer 1 is denoted by RR. Furthermore, a right portion of the printer 1 is denoted by R, a left portion of the printer 1 is denoted by L, an upper portion of the printer 1 is denoted by UP, and a lower portion of the printer 1 is denoted by DW.

The printer 1 is an ink jet print apparatus which includes an ink ejection unit 81 ejecting ink IK and which forms an image by ejecting the ink IK to a print medium W.

The print medium W used in the printer 1 may be formed of various materials, such as paper and a sheet of synthetic resin, and a sheet dedicated for ink jet recording including plain paper, high-quality paper, and glossy paper. In this embodiment, fabric of natural fibers, synthetic fibers, or the like is used as the print medium W. The printer 1 functions as a textile print apparatus performing printing on the print medium W by attaching the ink IK to a print surface of the print medium W, and the print medium W may be referred to as a printed member. Furthermore, in this embodiment, the printer 1 performs printing on a test medium 51 in addition to the print medium W. The test medium 51 is a print medium used for printing of a test pattern, and is a print sheet for photograph printing having properties of excellent absorption of the ink IK and bright coloration of the ink IK, for example. A width and a length of the test medium 51 are smaller than those of the print medium W, and the test medium 51 is a cut sheet of an A3 size, for example.

The printer 1 includes a delivery device 2, driven rollers 10A, 10B, and 10C, transport rollers 3A and 3B, a transport belt 4, and a reeling device 5 as an apparatus transporting the print medium W. The sections are included in a transport mechanism 140 described below.

The delivery device 2 delivers the rolled long print medium W to the transport belt 4. The delivery device 2 is positioned on a most upstream portion relative to the print medium W in a transport direction H. The delivery device 2 rotates a rotation shaft 2A in a counterclockwise direction in FIG. 1 and supplies the print medium W set in the rotation shaft 2A through the driven rollers 10A and 10B to the transport belt 4.

The transport rollers 3A and 3B are a pair of rollers driving the transport belt 4 by power of a transport motor 141 described below and at least one of the transport rollers 3A and 3B may be a driving roller and the other may be a driven roller.

The transport belt 4 is configured such that end portions of a rectangular flexible sheet of gum, synthetic resin, or composite material of gum and synthetic resin are coupled to each other so as to form an endless shape. The transport belt 4 is an example of a belt of the present disclosure. The transport belt 4 is hung on the transport rollers 3A and 3B and circularly moved in front and back directions of the printer 1 in accordance with rotation of the transport rollers 3A and 3B.

In a front portion of the printer 1, the print medium W delivered by the delivery device 2 is mounted on the transport belt 4, and the transport belt 4 transports the print medium W toward the rear portion of the printer 1 in the transport direction denoted by a reference character H. Here, a position where the print medium W is in contact with the transport belt 4 is referred to as a mounting start position I1.

The transport belt 4 has an abutting surface abutting on the print medium W and having viscosity. For example, when a glue belt having an abutting surface including a viscosity layer formed thereon is used as the transport belt 4, the print medium W is held by the transport belt 4 by the viscosity of the viscosity layer and is moved in a transport direction H along with the transport belt 4. Note that the transport belt 4 is not limited to the glue belt and an electrostatic adsorption belt adsorbing the print medium W by static electricity, for example, may be used.

As described below, the printer 1 may rotate the transport rollers 3A and 3B in a reversed direction. In this case, the transport belt 4 circularly moves the print medium W in a direction opposite to the transport direction H. In a description below, when the print medium W is transported in the transport direction H, a movement direction of the transport belt 4 is referred to as a belt movement direction F1. Furthermore, a movement direction of the transport belt 4 opposite to the belt movement direction F1 is referred to as a belt movement direction F2. The belt movement direction F1 corresponds to an example of a first direction of the present disclosure, and the belt movement direction F2 corresponds to an example of a second direction of the present disclosure.

The printer 1 includes a pressure roller 6, a medium sensor 71, and a print unit 8 along a movement path of the print medium W.

The pressure roller 6 and the medium sensor 71 are disposed on a downstream relative to the mounting start position I1 in the transport direction H. The pressure roller 6 is biased by a biasing mechanism, such as a spring, not illustrated, toward the transport belt 4 so as to press the print medium W to the transport belt 4. By this, the print medium W is tightly supported by the transport belt 4 so that floating of the print medium W is suppressed. The pressure roller 6 is rotatable in accordance with transport of the print medium W so that a mark of the pressure roller 6 is not left on the print medium W.

The medium sensor 71 is an optical sensor including a light emitting section emitting light to the print medium W and a light receiving section receiving and detecting light. For example, the medium sensor 71 is configured as a reflection optical sensor receiving reflection light from the print medium W using the light receiving section. A controller 100 described below detects the print medium W beneath the medium sensor 71 based on an amount of light detected by the light receiving section of the medium sensor 71. Furthermore, the controller 100 may detect a distance from the medium sensor 71 to a surface of the print medium W based on a difference between a light emitting timing and a light receiving timing of the medium sensor 71.

The print unit 8 is disposed on the downstream of the medium sensor 71 in the transport direction H. The print unit 8 includes the ink ejection unit 81 forming an image on the print medium W, a carriage 82 having the ink ejection unit 81 mounted thereon, and a gap adjustment mechanism 83 adjusting a relative position of the carriage 82 relative to the print medium W. Furthermore, the carriage 82 includes a scan unit 72 and a belt sensor 73 described below.

The ink ejection unit 81 includes a plurality of nozzles opening toward the print medium W and forms an image on the print medium W by ejecting the ink IK from the nozzles to the print medium W. A process of forming an image using the ink IK is referred to as printing. Furthermore, a surface of the ink ejection unit 81 on which the nozzles are opened is referred to as a nozzle surface 81A and a surface of the print medium W on which the ink IK adheres is referred to as a print surface.

An ink supply path 11 is coupled to the ink ejection unit 81. The ink IK is supplied from an ink storage section, not illustrated, through the ink supply path 11 to the ink ejection unit 81. A configuration of the ink ejection unit 81 will be described hereinafter with reference to FIG. 2.

The carriage 82 reciprocates in a scanning direction denoted by a reference character K on the print medium W. The scanning direction K of the carriage 82 intersects with the transport direction H, and in particular, the scanning direction K orthogonally intersects with the transport direction H as an example of this embodiment.

The ink ejection unit 81 moves on the print medium W in the scanning direction K in accordance with the movement of the carriage 82. By this, the printer 1 may form an image in a range extending in the scanning direction K and the transport direction H.

The gap adjustment mechanism 83 adjusts a work gap WG which is a distance between the print medium W and the nozzle surface 81A of the ink ejection unit 81 by moving the carriage 82 in a vertical direction.

The scan unit 72 mounted on the carriage 82 is a scanner optically reading an image printed on the print medium W. The scan unit 72 is constituted by a charge coupled device (CCD) scanner or a digital still camera, for example. The scan unit 72 performs scanning along with the carriage 82 so that an entire image printed on the print medium W may be optically read by the scan unit 72.

The belt sensor 73 is mounted on the carriage 82 along with the scan unit 72. The belt sensor 73 detects a distance from the belt sensor 73 and detects a distance between the transport belt 4 on which the print medium W is not mounted and the belt sensor 73. As the belt sensor 73, an optical time of flight (TOF) sensor performing ranging by emitting infrared light to the transport belt 4 and detecting reflection light, other ranging sensors, or a proximity sensor may be used. A distance between the belt sensor 73 and the viscosity surface of the transport belt 4 may be measured in a range extending in the scanning direction K by causing the belt sensor 73 to perform scanning in the scanning direction K along with the carriage 82.

The printer 1 includes an exterior package 15 accommodating the print unit 8. The exterior package 15 is a case having a substantially box shape covering an upper portion of the print medium W in the transport direction H. In this embodiment, a range from the mounting start position I1 to the print unit 8 is covered by the exterior package 15.

The print medium W is peeled from the transport belt 4, guided by the driven roller 10C, and reeled by the reeling device 5 on a downstream of the print unit 8. A position where the print medium W is separated from the transport belt 4 is referred to as a mounting end position I2.

The reeling device 5 reels the print medium W in a roll shape on a reel set in a rotation shaft 5A by rotating in a counterclockwise direction of FIG. 1 with the rotation shaft 5A at the center.

A dry unit 9 is disposed between the driven roller 10C and the reeling device 5. The dry unit 9 dries the ink IK attached to the print medium W before the print medium W is reeled by the reeling device 5. For example, the dry unit 9 includes a chamber accommodating the print medium W and a heater disposed in the chamber, and heats and dries the print medium W. The dry unit 9 is at least positioned between the ink ejection unit 81 and the reeling device 5 in the transport direction H, and the position of the dry unit 9 is not limited to a downstream of the driven roller 10C.

Figure 2:
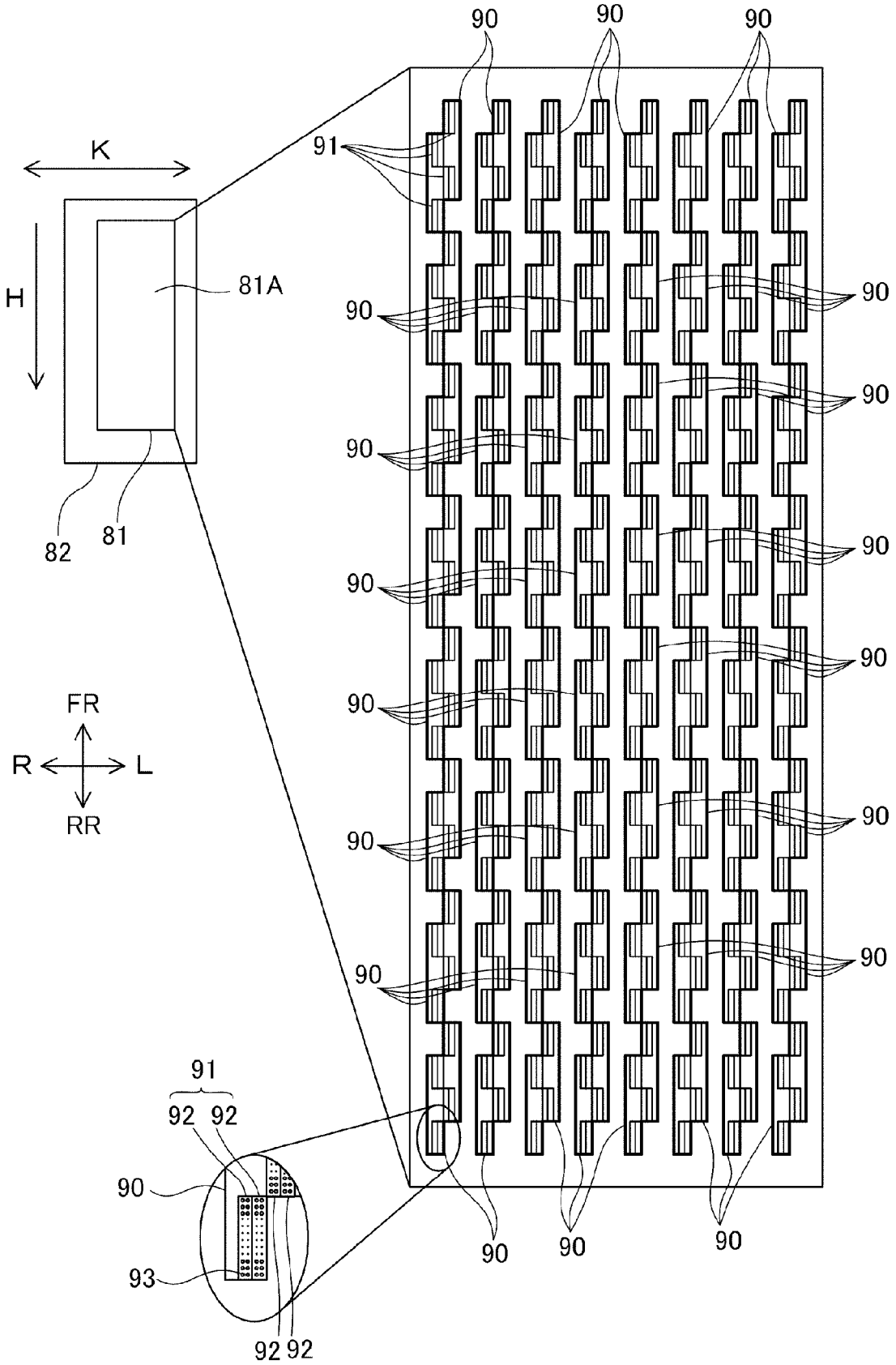
FIG. 2 is a diagram illustrating a configuration of a print head.

FIG. 2 is a diagram illustrating a configuration of the ink ejection unit 81 in detail. FIG. 2 includes a diagram of the ink ejection unit 81 viewed from the nozzle surface 81A and an enlarged view of the nozzle surface 81A.

In the nozzle surface 81A, a plurality of print heads 90 are arranged in the scanning direction K and a direction orthogonal to the scanning direction K.

Each of the print heads 90 includes a plurality of chips 91. In the example of FIG. 2, each of the print heads 90 includes four chips 91 arranged in a zig-zag manner in the transport direction H orthogonally intersecting with the scanning direction K. The ink ejection unit 81 has 64 print heads 90 arranged in eight columns in the scanning direction K and eight rows in the transport direction H and 256 chips 91.

In a circle in a lower portion of FIG. 2, an essential portion of one of the print heads 90 is enlarged. Each of the chips 91 includes two nozzle lines 92, and each of the nozzle lines 92 includes a plurality of nozzles 93 arranged therein which individually eject ink IK. The two nozzle lines 92 included in each of the chips 91 may be assigned to ink IK of different colors. Furthermore, the eight chips 91 included in one print head 90 have the nozzle lines 92 of the same colors. Accordingly, one print head 90 may eject the ink IK of two colors.

For example, the ink ejection unit 81 may eject ink of cyan (C), magenta (M), yellow (Y), and black (K). Alternatively, the ink ejection unit 81 may eject the ink IK of light cyan, light magenta, orange, green, gray, light gray, white or the like or eject the ink IK, such as metallic colors. Furthermore, soakage prompting permeation of the ink IK to the print medium W may be ejected from the ink ejection unit 81. Colors of the ink IK to be ejected are assigned to the chips 91 included in the ink ejection unit 81 in a unit of the nozzle line 92 and multi-color printing may be performed by the ink ejection unit 81.

The print heads 90 are detachable from the carriage 82. Specifically, the print heads 90 of the ink ejection unit 81 are replaceable. For example, when the number of nozzles 93 of ink ejection failure exceeds a predetermined number in the nozzle lines 92, the print heads 90 are replaced to address the problem.

When one of the print heads 90 is replaced, alignment of the replaced print head 90 may be shifted from that of the other print heads 90. The term "alignment" means inclination and a height of the nozzle surface 81A of the print head 90. When a position of the replaced print head 90 in the carriage 82 does not match the print head 90 before the replacement, for example, a difference between the alignments, that is, an alignment shift occurs.

The alignment shift generates a shift of a timing when the ink IK ejected from the nozzles 93 impacts on a surface of the print medium W and invites a shift of a position of a dot to be formed by the ink IK on the print medium W. The alignment shift may include, in addition to a height and an inclination of the nozzle surface 81A, various elements affecting a position and a timing of impact of the ink IK ejected from the nozzles 93 on the print medium W.

To maintain high print quality, the alignment shift of the print head 90 is detected and correction is preferably performed such that the ink IK ejected from the replaced print head 90 forms a dot in the same position as a dot of the print head 90 before replacement.

Furthermore, the alignment shift of the print head 90 may occur due to not only replacement of the print head 90 but also aging of the print head 90. Also in this case, it is effective that the alignment shift is detected and correction is performed where appropriate.

The printer 1 has a function of detecting an alignment shift with one or a plurality of print heads 90 as a unit. This function is referred to as examination of an alignment shift. Specifically, a test image is printed using the print head 90 to be examined, the printed image is read by the scan unit 72, a position of dots formed by the print head 90 to be examined is examined. The test image is generated to cause all the nozzles 93 included in the print head 90 to be examined to form dots and is a so-called test pattern. In this examination, the print head 90 before replacement is used as a reference, and a difference between alignment of the print head 90 before the replacement and alignment of the replaced print head 90 is detected as a difference between positions of dots.

As a medium to be used in printing of a test pattern, the print medium W may be used but a medium different from the print medium W is preferably used. This is because transport in the transport direction H is required to be stopped to read the test pattern using the scan unit 72 and a portion in which the test pattern is printed is required to be removed or discarded, for example.

Furthermore, an examination target is one of the print heads 90 included in the ink ejection unit 81, and therefore, a large medium covering the entire scanning direction K is not required for the printing of a test pattern.

Therefore, in this embodiment, the test medium 51 which is a cut sheet of a regular size is used for the printing of a test pattern when the alignment shift of the print head 90 is examined. The test medium 51 may be a plain paper or a so-called PPC sheet. Furthermore, a photo print sheet having characteristics of excellent absorbency and excellent retentivity of the ink IK and a characteristic of less ink bleeding may be used. The test medium 51 corresponds to an example of a second print medium of the present disclosure and the print medium W corresponds to an example of a first print medium of the present disclosure.

Figure 3:
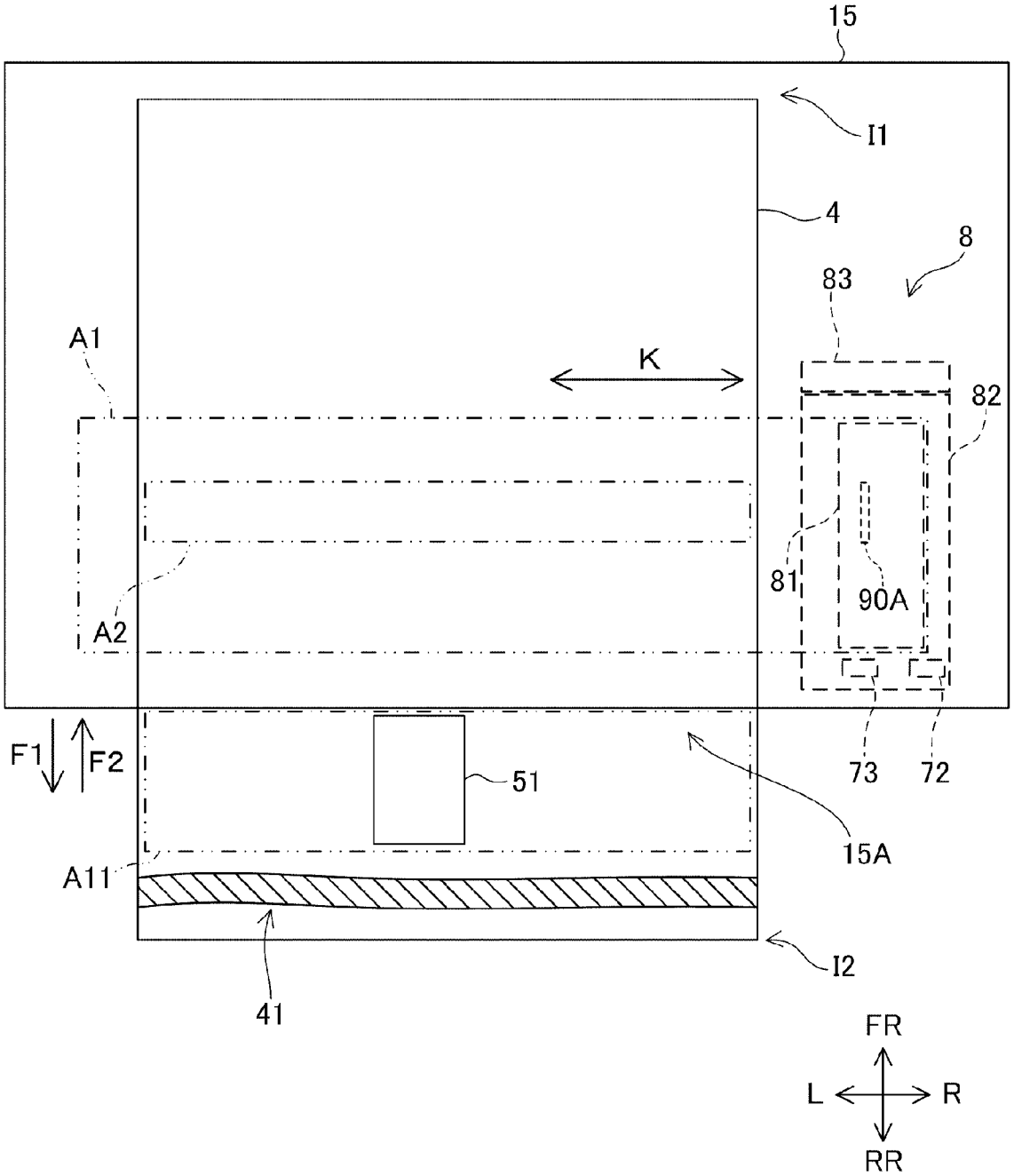
FIG. 3 is a plan view of an essential portion of the printer according to a first embodiment.

FIG. 3 is a plan view of an essential portion of the printer 1. FIG. 3 is a diagram illustrating a state in which the print medium W is not mounted on the transport belt 4.

The carriage 82 may be moved to a position deviated rightward from the print medium W in the scanning direction K. This position is referred to as a home position. In the home position, a maintenance mechanism is disposed to execute maintenance of the ink ejection unit 81, such as flushing and cleaning, to suppress nozzle clog of the ink ejection unit 81.

A region in which an image may be formed when the ink ejection unit 81 performs scanning in the scanning direction K is referred to as a print region A1 in FIG. 3. The print region A1 indicates an outer edge of a print available region in the scanning direction K, and the print available region in the transport direction H is extended by movement of the transport belt 4.

In FIG. 3, the test medium 51 of an A3 size of 594 mm in height by 297 mm in width is used as an example.

The transport belt 4 is exposed outside the exterior package 15 in a position near the mounting end position I2, and therefore, the test medium 51 is mounted on the transport belt 4 in the vicinity of the mounting end position I2. An operation of mounting the test medium 51 is executed by an operator of the printer 1. A position where the test medium 51 is mounted by the operator is a test medium set region A11. The test medium set region A11 is set in advance in a position where the test medium 51 is easily mounted by the operator.

The ink ejection unit 81 may print a test pattern irrespective of a position of the test medium 51 in the scanning direction K. Assuming that a print head 90A is to be examined, a region in which the print head 90A may perform printing in the scanning direction K is a print region A2 illustrated in FIG. 3. However, a more preferred position of the test medium 51 may be determined in advance by examination in the scanning direction K taking smoothness of the transport belt 4 or the like into consideration.

Figure 4:
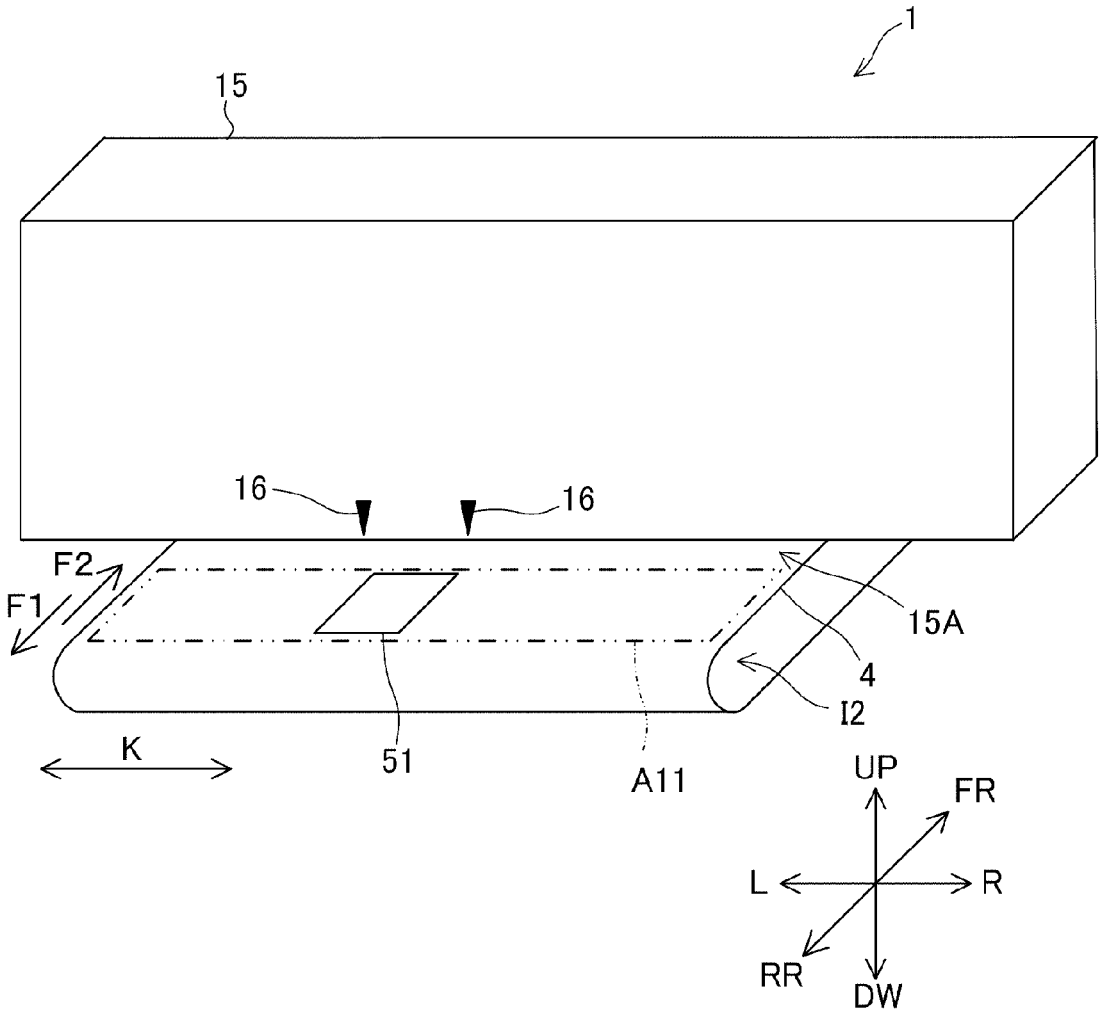
FIG. 4 is a perspective view of the printer.

FIG. 4 is a perspective view of the printer 1 when the printer 1 is viewed from a rear side.

As illustrated in FIG. 4, the transport belt 4 is exposed from a rear end portion 15A of the exterior package 15 when the print medium W is not mounted on the transport belt 4. The test medium set region A11 is set in a position where the transport belt 4 is exposed outside the exterior package 15.

Markers 16 are positioned in an upper portion of the rear end portion 15A of the exterior package 15. The markers 16 are a display section for indicating a position where the test medium 51 is to be mounted on the transport belt 4 for the operator. In the example of FIG. 4, the two markers 16 indicating positions of opposite ends of the test medium 51 are disposed on the exterior package 15. The markers 16 is at least visible in the exterior package 15, and members of a shape of the markers 16 may be attached to the exterior package 15 or the markers 16 may be formed by painting or printing.

The markers 16 function as a position indication section indicating a position of the test medium 51 in the scanning direction K. Furthermore, since the markers 16 are disposed on the exterior package 15, the markers 16 have a function of instructing mounting of the test medium 51 so as to align the test medium 51 to the rear end portion 15A. Accordingly, the markers 16 of this embodiment function as a position indication section indicating a position where the test medium 51 is set in the belt movement directions F1 and F2 and the scanning direction K.

Note that a position indication section indicating a position of the test medium 51 in the belt movement directions F1 and F2 other than the markers 16 may be disposed.

The positions of the markers 16 in the scanning direction K and the position of the print region A1 in the belt movement direction F1 are included in setting data 122 to be stored in a storage section 120.

When the test medium 51 is mounted on the transport belt 4 by the operator such that the test medium 51 aligns in the positions indicated by the markers 16 in the test medium set region A11, an alignment shift of the print head 90A may be examined under a preferred condition.

As illustrated in FIG. 3, the test medium set region A11 is positioned on a downstream of the ink ejection unit 81 in the belt movement direction F1. After the test medium 51 is mounted on the transport belt 4, the printer 1 moves the transport belt 4 in the belt movement direction F2. Specifically, the transport belt 4 is transported in a direction opposite to a direction of printing on the print medium W so that the test medium 51 is moved to a print region A2. The printer 1 ejects ink from the print head 90A to be examined while causing the ink ejection unit 81 to perform scanning so that a test pattern is printed on the test medium 51. Thereafter, the printer 1 moves the transport belt 4 in the belt movement direction F1 and transports the test medium 51 in the transport direction H while being aligned in the scan unit 72. The printer 1 uses the scan unit 72 to read dots of the test pattern formed on the test medium 51 and detect positions of the dots so as to detect an alignment shift of the print head 90A to be examined. Furthermore, the printer 1 generates correction data for correcting the alignment shift of the print head 90A to be examined. The correction data of this embodiment is used to correct a timing when the ink IK is ejected from the nozzles 93 of the print head 90A to be examined when printing is performed on the print medium W. Use of the correction data may match a timing when the print head 90A to be examined ejects the ink IK with a timing of the other print heads 90, and accordingly, deterioration of print quality caused by replacement of the print head 90 may be suppressed or prevented.

The transport belt 4 is formed by joining end portions of a rectangle sheet as described above, and a joint portion of the sheet has a thickness and rigidity which are different from those of the other portions. This portion is referred to as a joint 41 and is illustrated in FIG. 3. The joint 41 extends in a width direction of the transport belt 4, that is, a lateral direction of the printer 1. The joint 41 corresponds to an example of a joint section of the present disclosure.

In examination of an alignment shift of the print heads 90, when the test medium 51 is mounted on a position overlapping with the joint 41, the test medium 51 may be slightly distorted or roughness may be generated on the test medium 51, and the distortion or the roughness may affect accuracy of the examination. Therefore, the printer 1 moves the transport belt 4 such that the joint 41 is not included in the test medium set region A11 when the test medium 51 is mounted on the transport belt 4.

Figure 5:
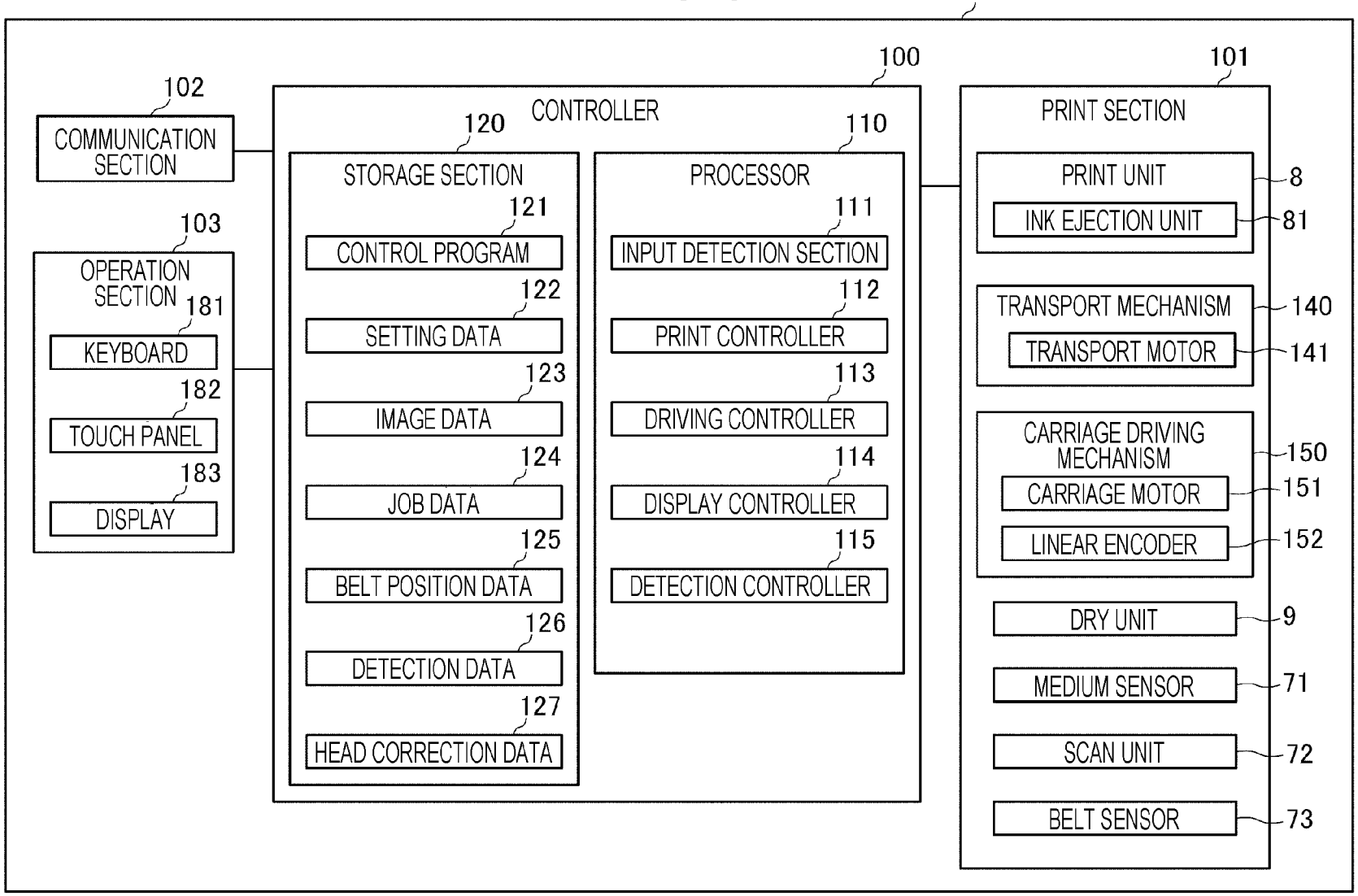
FIG. 5 is a block diagram illustrating a functional configuration of the printer.

FIG. 5 is a block diagram illustrating a functional configuration of the printer 1.

The printer 1 includes the controller 100.

The controller 100 includes a processor 110 executing programs, such as a central processing unit (CPU), a graphics processing unit (GPU), or a micro processing unit (MPU) and controls various sections in the printer 1. The controller 100 executes various processes in cooperation with hardware and software so that the processor 110 reads and executes a control program 121 stored in the storage section 120. The control program 121 corresponds to an example of a control program. Furthermore, the processor 110 functions as an input detection section 111, a print controller 112, a driving controller 113, a display controller 114, and a detection controller 115 when reading and executing the control program 121.

The storage section 120 includes a storage region storing programs to be executed by the processor 110 and data to be processed by the processor 110. The storage section 120 stores the control program 121 to be executed by the processor 110 and the setting data 122 including various setting values associated with operation of the printer 1.

The storage section 120 includes a nonvolatile storage region storing programs and data in a nonvolatile manner. Alternatively, the storage section 120 may include a volatile storage region temporarily storing programs to be executed by the processor 110 and data to be processed.

A print section 101, a communication section 102, and an operation section 103 are coupled to the controller 100. The print section 101 includes a print unit 8, the transport mechanism 140, a carriage driving mechanism 150, the dry unit 9, the medium sensor 71, the scan unit 72, and the belt sensor 73.

The controller 100 controls the ink ejection unit 81. Each of the print heads 90 of the ink ejection unit 81 includes a mechanism for ejecting the ink IK from the nozzles 93 using a piezoelectric element or a heat element and ejects the ink IK under control of the controller 100.

The transport mechanism 140 is used to transport the print medium W and includes the delivery device 2, the driven rollers 10A, 10B, and 10C, the transport rollers 3A and 3B, the transport belt 4, and the reeling device 5, and further includes the transport motor 141 driving these sections. The controller 100 controls driving, stop, a rotation direction, and a rotation amount of the transport motor 141. Furthermore, the controller 100 may control a rotation speed of the transport motor 141. The transport motor 141 corresponds to an example of a driving section of the present disclosure.

The carriage driving mechanism 150 is used to reciprocate the carriage 82 in the scanning direction K and includes a carriage motor 151 serving as a driving source and a linear encoder 152 detecting a position of the carriage 82 in the scanning direction K. The controller 100 detects a position of the carriage 82 based on an output of the linear encoder 152 and controls the carriage motor 151 so as to move the carriage 82. Furthermore, the carriage driving mechanism 150 may include a guide member guiding a movement of the carriage 82 and a gear and a link transmitting power of the carriage motor 151 to the carriage 82. Furthermore, when the controller 100 may specify a position of the carriage 82 based on an operation amount of the carriage motor 151, the linear encoder 152 may be omitted.

The controller 100 controls a heater of the dry unit 9 to be turned on or off and a heat temperature of the heater. The controller 100 obtains a detection value of the medium sensor 71 so as to detect whether the print medium W has been mounted on the transport belt 4. The controller 100 obtains a detection value of the scan unit 72 so as to analyze an image read by the scan unit 72. For example, the controller 100 specifies positions of dots formed by the nozzles 93 in the image read by the scan unit 72 so as to detect an alignment shift. The controller 100 obtains a detection value of the belt sensor 73 so as to detect a distance between the belt sensor 73 and the transport belt 4 and/or a change in the distance. The scan unit 72 corresponds to an example of a belt pattern detection section according to the present disclosure, and the belt sensor 73 corresponds to an example of a distance detection section according to the present disclosure.

The communication section 102 is configured by communication hardware including a connector based on a predetermined communication standard and an interface circuit, and communicates with an external apparatus of the printer 1 under control of the controller 100. Examples of the external apparatus of the printer 1 include a computer and a server apparatus. When receiving image data 123 from the external apparatus through the communication section 102, the controller 100 stores the received image data 123 in the storage section 120. Furthermore, when receiving job data 124 for instructing printing from the external apparatus through the communication section 102, the controller 100 stores the received job data 124 in the storage section 120. A communication method employed in the communication section 102 may be a wired communication or a wireless communication and a type of the communication standard may be appropriately selected.

The operation section 103 receives an operation performed by the operator of the printer 1. Although the operation section 103 including a keyboard 181, a touch panel 182, and a display 183 is illustrated as an example in FIG. 5, the operation section 103 may include other input devices.

The keyboard 181 has a plurality of keys operated by the operator and outputs operation data indicating an operated key to the controller 100. The display 183 includes a display screen, such as a liquid display panel, and displays various information associated with operations of the printer 1 under control of the controller 100. The touch panel 182 disposed on the display screen of the display 183 in an overlapping manner detects a touch operation on the display screen and outputs operation data indicating a touched position to the controller 100.

The storage section 120 stores, in addition to the control program 121 and the setting data 122, the image data 123, the job data 124, belt position data 125, detection data 126, and head correction data 127.

The image data 123 corresponds to an image printed by the printer 1 and includes an image of a test pattern printed in examination of an alignment shift. The job data 124 indicates a print job to be executed by the printer 1. The belt position data 125 indicates a position of the joint 41 of the transport belt 4 in a circumferential direction. The belt position data 125 may indicate a distance from a reference position of the transport belt 4 to the joint 41, for example. Furthermore, the belt position data 125 may indicate a relative position of the current joint 41 relative to positions of the ink ejection unit 81 and the exterior package 15, the mounting start position I1, the mounting end position I2, and the like.

The detection data 126 includes detection values and data output from the various sensors including the medium sensor 71, the scan unit 72, and the belt sensor 73. The detection data 126 includes a detection value of the medium sensor 71, an image read by the scan unit 72, and a detection value of the belt sensor 73, for example.

The head correction data 127 is used to correct operation of the print heads 90 and generated based on a result of examination of an alignment shift. For example, the head correction data 127 is used to shift a timing when the print head 90 ejects the ink IK from an initial value.

The input detection section 111 detects an input operation performed by the operator based on operation data input by the operation section 103 and obtains input content. The input detection section 111 processes data received through the communication section 102. When receiving the image data 123 and the job data 124 through the communication section 102, the input detection section 111 stores the received data in the storage section 120.

The print controller 112 controls the print section 101 in accordance with the job data 124 and executes printing on the print medium W using the print section 101.

Furthermore, the print controller 112 executes examination of an alignment shift of the print head 90. When detecting replacement of one of the print heads 90 in the ink ejection unit 81 by control on the ink ejection unit 81 or an input to the operation section 103, the print controller 112 specifies the print head 90 to be examined and performs examination of an alignment shift. The print controller 112 prints a test pattern using the print head 90 to be examined, causes the scan unit 72 to read an image of the test pattern, generates head correction data 127 based on the read image, and stores the head correction data 127 in the storage section 120. The print controller 112 corresponds to an example of a specifying section according to the present disclosure.

The driving controller 113 controls the transport motor 141 so as to control a movement direction and a movement amount of the transport belt 4 and transport of the print medium W. Furthermore, the driving controller 113 controls the carriage motor 151 based on a detection value of the linear encoder 152 so as to control scanning of the carriage 82. The driving controller 113 operates the carriage 82 and the transport belt 4 at a timing when the print controller 112 drives the ink ejection unit 81 when printing is performed on the print medium W.

The driving controller 113 drives the transport motor 141 so as to move the transport belt 4 when examination of an alignment shift of the print head 90 is executed. For example, the driving controller 113 performs control such that the transport belt 4 is moved so that the joint 41 does not overlap with the test medium set region A11. Furthermore, the driving controller 113 performs control such that the test medium 51 is moved to the print region A1 and control such that the test medium 51 on which a test pattern is printed is moved to a position of the scan unit 72, for example.

The display controller 114 controls the display 183 so as to display various images.

The detection controller 115 controls the medium sensor 71, the scan unit 72, and the belt sensor 73 so as to obtain detection values of the sensors and a read image to be stored in the storage section 120 as detection data 126.

Figure 6:
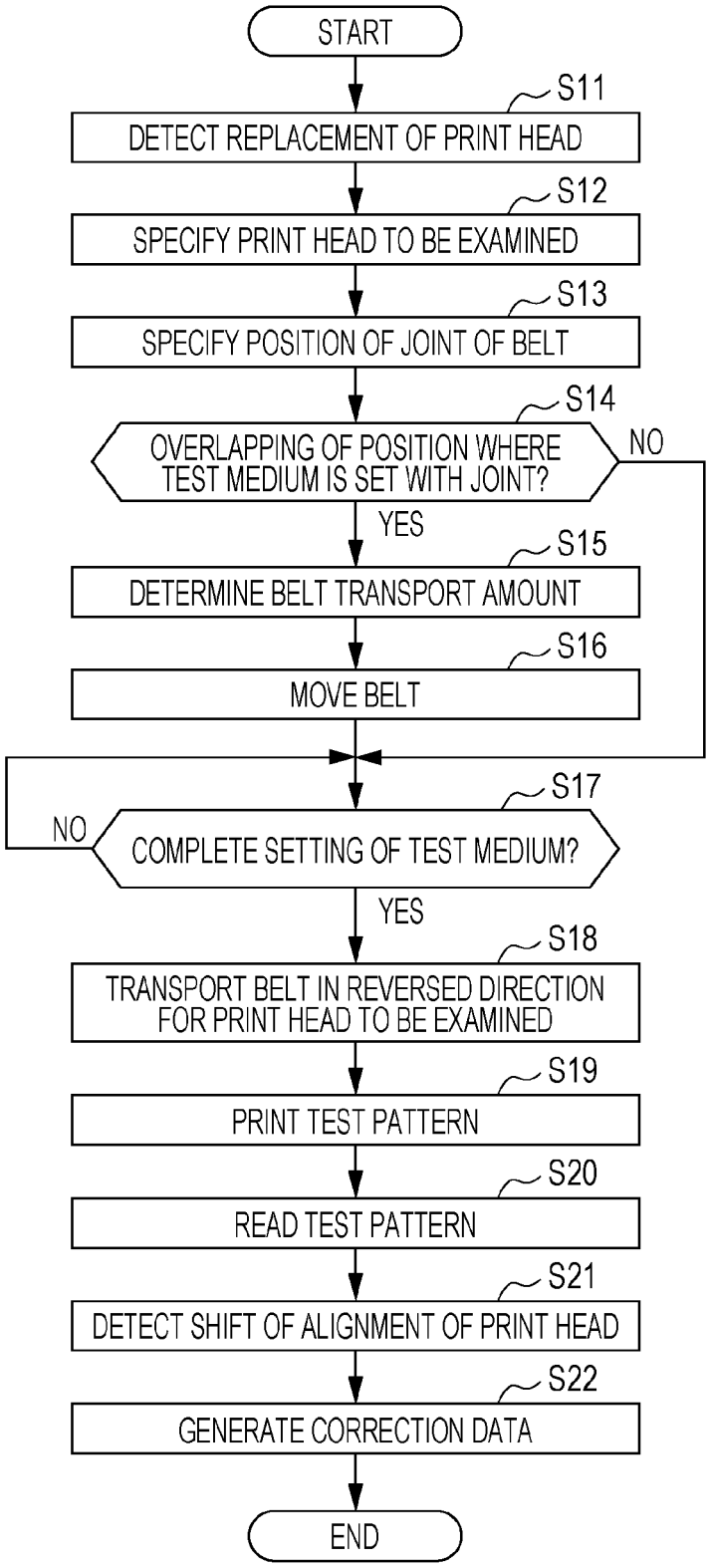
FIG. 6 is a flowchart of an operation of the printer according to the first embodiment.

FIG. 6 is a flowchart of an operation of the printer 1 and the operation is associated with examination of an alignment shift.

The operation illustrated in FIG. 6 is executed under control of the processor 110, step S11 to step S15, step S17 and step S18, and step S21 and step S22 correspond to operations of the print controller 112, and step S16 and step S18 correspond to operations of the driving controller 113. Step S19 corresponds to operations of the print controller 112 and the driving controller 113, and step S20 corresponds to operations of the print controller 112 and the detection controller 115.

When detecting replacement of one of the print heads 90 (step S11), the controller 100 specifies one of the print heads 90 which is a target of examination of an alignment shift (step S12).

The controller 100 specifies a position of the joint 41 of the transport belt 4 (step S13) and determines whether the test medium set region A11 overlaps with the joint 41 (step S14). When it is determined that the test medium set region A11 overlaps with the joint 41 (step S14; YES), the controller 100 calculates and determines a movement amount of the transport belt 4 required until the joint 41 moves out of the test medium set region A11 (step S15). The controller 100 cause the transport motor 141 to perform normal rotation in accordance with the movement amount determined in step S15, moves the transport belt 4 in the belt movement direction F1, and stops the transport motor 141 (step S16). In step S15, the transport motor 141 may be rotated in a reversed direction so that the transport belt 4 is moved in the belt movement direction F2.

The controller 100 determines whether the test medium 51 has been mounted on the test medium set region A11 by the operator (step S17) and waits until the test medium 51 is mounted (step S17; NO). For example, the operator inputs information indicating the completion of setting of the test medium 51 by operating the operation section 103 after the test medium 51 is mounted on the transport belt 4. When the setting of the test medium 51 is completed (step S17; YES), the controller 100 reversely rotates the transport motor 141 so as to move the transport belt 4 in the belt movement direction F2 and transports the test medium 51 (step S18). In step S18, the test medium 51 is transported to the print region A2 which is a print position of the print head 90 to be examined.

The controller 100 causes the print head 90 to be examined to print a test pattern (step S19). The controller 100 prints the test pattern in accordance with the markers 16 with reference to the setting data 122. After the printing, the controller 100 causes the scan unit 72 to read the test pattern printed on the test medium 51 (step S20). The controller 100 may operate the transport motor 141 so that the test medium 51 is transported to a reading position of the scan unit 72 before executing the process in step S20.

The controller 100 analyzes the image read by the scan unit 72 so as to detect an alignment shift of the print head 90 to be examined (step S21). In step S21, the controller 100 specifies positions of the dots formed by the print head 90 to be examined and obtains a shift of the positions of the dots relative to a reference positions so as to obtain an alignment shift. When the controller 100 detects replacement of one of the print heads 90, for example, a shift amount of positions of dots formed by the print head 90 before the replacement and the positions of the dots formed by the print head 90 to be examined is calculated.

The controller 100 generates head correction data 127 for correction of the alignment shift and stores the head correction data 127 in the storage section 120 as correction data for the print head 90 to be examined. For example, the controller 100 calculates a correction value at an ejection timing corresponding to a shift amount of the positions of the dots obtained in step S21 and determines the correction value as the head correction data 127.

The print controller 112 controls a timing when the print head 90 ejects the ink IK with reference to the head correction data 127 when performing normal printing on the print medium W in accordance with the job data 124.

As described above, the printer 1 of the first embodiment to which the present disclosure is applied includes the print heads 90 ejecting ink to the print medium W and the test medium 51 and the transport belt 4 on which the print medium W and the test medium 51 are mounted. The printer 1 includes the transport motor 141 transporting the print medium W or the test medium 51 by moving the transport belt 4 and the print controller 112 specifying one of the print heads 90 to be adjusted using a test pattern. The printer 1 further includes the markers 16 indicating a position of the test medium 51 when a test pattern is printed and the driving controller 113 controlling the transport motor 141. The driving controller 113 adjusts a position of the test medium 51 by controlling the transport motor 141 in accordance with the print head 90 to be examined specified by the print controller 112.

According to a method for controlling the printer 1, when the print head 90 to be examined using the test pattern is specified, the transport belt 4 is moved in accordance with the specified print head 90 to be examined so that a position of the test medium 51 is adjusted.

The control program 121 moves the transport belt 4, when the print head 90 to be examined using the test pattern is specified by the controller 100, in accordance with the specified print head to be examined and adjusts a position of the test medium 51.

The printer 1 employing the print apparatus, the method for controlling the print apparatus, and the control program according to the present disclosure may adjust a position of the test medium 51 to a position corresponding to the print head 90 to be examined. Therefore, restriction of a position where the test medium 51 is to be set when the print head 90 is controlled and a size of the test medium 51 is relaxed and control may be more easily performed on the print head 90.

For example, when the print head 90 is examined, the test medium 51 may be set in a position separated from a print position of the print head 90 to be examined. Furthermore, a size of the test medium 51 is at least sufficient for printing of the test pattern, for example, and may be smaller than a size of the print region A1 in the scanning direction K. Accordingly, a load of examination on the print head 90 may be reduced. Furthermore, since the restriction on a size and a position of the test medium 51 is relaxed, a degree of freedom of selection of the test medium 51 is enhanced. For example, when the test medium 51 more suitable for printing of the test pattern than the print medium W is used, accuracy of examination and adjustment using the test pattern may be enhanced.

In particular, when the printer 1 is a large print apparatus performing printing on the print medium W having a width in a range from 1 m to 2 m or more, it is not easy to prepare the test medium 51 of a size equivalent to a size of the print medium W. Furthermore, when the print medium W is fabric and the print medium W is used for printing of a test pattern, an operation of removing a portion including a printed test pattern from the print medium W reeled by the reeling device 5 is required. Furthermore, cost of the print medium W consumed for the adjustment is not negligible. Furthermore, it is not easy to accurately detect positions of dots formed on the fabric using the scan unit 72 and detect an alignment shift. The scan unit 72 is positioned on an upstream of the dry unit 9 in the transport direction H, and therefore, dots of a test pattern are detected in the print medium W before being dried by the dry unit 9 and it is difficult to enhance detection accuracy.

When the printer 1 may use the test medium 51 smaller than the print medium W at a time of adjustment and examination of the print head 90, the problem described above is solved. Specifically, when the test medium 51 of a regular size which is inexpensive and has handleability is used, the print medium W is not consumed for printing a test pattern and cost and a load of adjustment of the print head 90 may be reduced. Furthermore, the position where the test medium 51 is set is not limited to the position of the carriage 82 and may be outside the exterior package 15, and in this case, an operation load of the operator may be considerably reduced. Furthermore, the test medium 51 is set to the transport belt 4 on which the print medium W is not mounted. Therefore, it is advantageous in that the print head 90 after replacement may be adjusted in a state in which the print medium W is removed from the printer 1 before the print head 90 is replaced. Furthermore, when the test medium 51 which is excellent in absorbency of the ink IK and clarity of dots is used, positions of dots may be detected with high accuracy. Accordingly, when the present disclosure is employed in a large sized printer 1 performing printing on a large sized print medium W, loads of examination and adjustment using a test pattern are reduced and accuracy is highly effectively enhanced.

The printer 1 includes the scan unit 72 detecting a test pattern printed on the test medium 51, and the driving controller 113 may detect an alignment shift of the print head 90 based on a detection result of the scan unit 72. With this configuration, an alignment shift may be detected with high accuracy by printing a test pattern on the test medium 51 and detecting the printed test pattern.

The printer 1 includes a plurality of print heads 90 and the print controller 112 specifies a replaced one of the print heads 90 as a print head 90 to be examined. The print head 90 to be examined corresponds to a replaced head. With this configuration, print quality may be maintained even after an alignment shift occurring due to replacement of the print head 90 is detected and the print head 90 is replaced.

The print head 90 may perform printing on the print medium W for image printing and the test medium 51 on which a test pattern is to be printed and which is different from the print medium W. When an image is printed on the print medium W using the print heads 90, the driving controller 113 transports the print medium W by moving the transport belt 4 in the belt movement direction F1. When the test medium 51 is moved to a position of the print head 90 specified by the print controller 112 to print a test pattern, the driving controller 113 moves the transport belt 4 in the belt movement direction F2 which is different from the belt movement direction F1. With this configuration, the transport belt 4 is moved in a direction different from that in printing on the print medium W so that the test medium 51 is positioned in the print head 90. Accordingly, a degree of freedom of a position where the test medium 51 is set is enhanced, and a load of an operation of setting the test medium 51 performed by the operator may be reduced.

A position of the test medium 51 specified by the markers 16 may be positioned on a downstream of the print heads 90 in the belt movement direction F1. With this configuration, a load of the operation of setting the test medium 51 performed by the operator may be further reduced.

The test medium 51 is a cut sheet of a regular size, and the printer 1 detects an alignment shift of the print head 90 by optically reading a test pattern printed on the test medium 51. Since the test medium 51 is a regular size, the test medium 51 which is excellent in color development of a test pattern may be used. Accordingly, an alignment shift may be detected with higher accuracy.

The printer 1 includes the transport belt 4 processed in an endless shape by coupling opposite ends of a long belt member. The driving controller 113 moves the belt before the print medium W is mounted when the joint 41 of the transport belt 4 is positioned in a predetermined range from a position of the test medium 51 specified by the markers 16, or the test medium set region A11, for example. With this configuration, the test medium 51 may be set in a portion other than the joint 41 of the transport belt 4 and adjustment of an alignment shift may be performed with higher accuracy.

Second Embodiment

Figure 7:
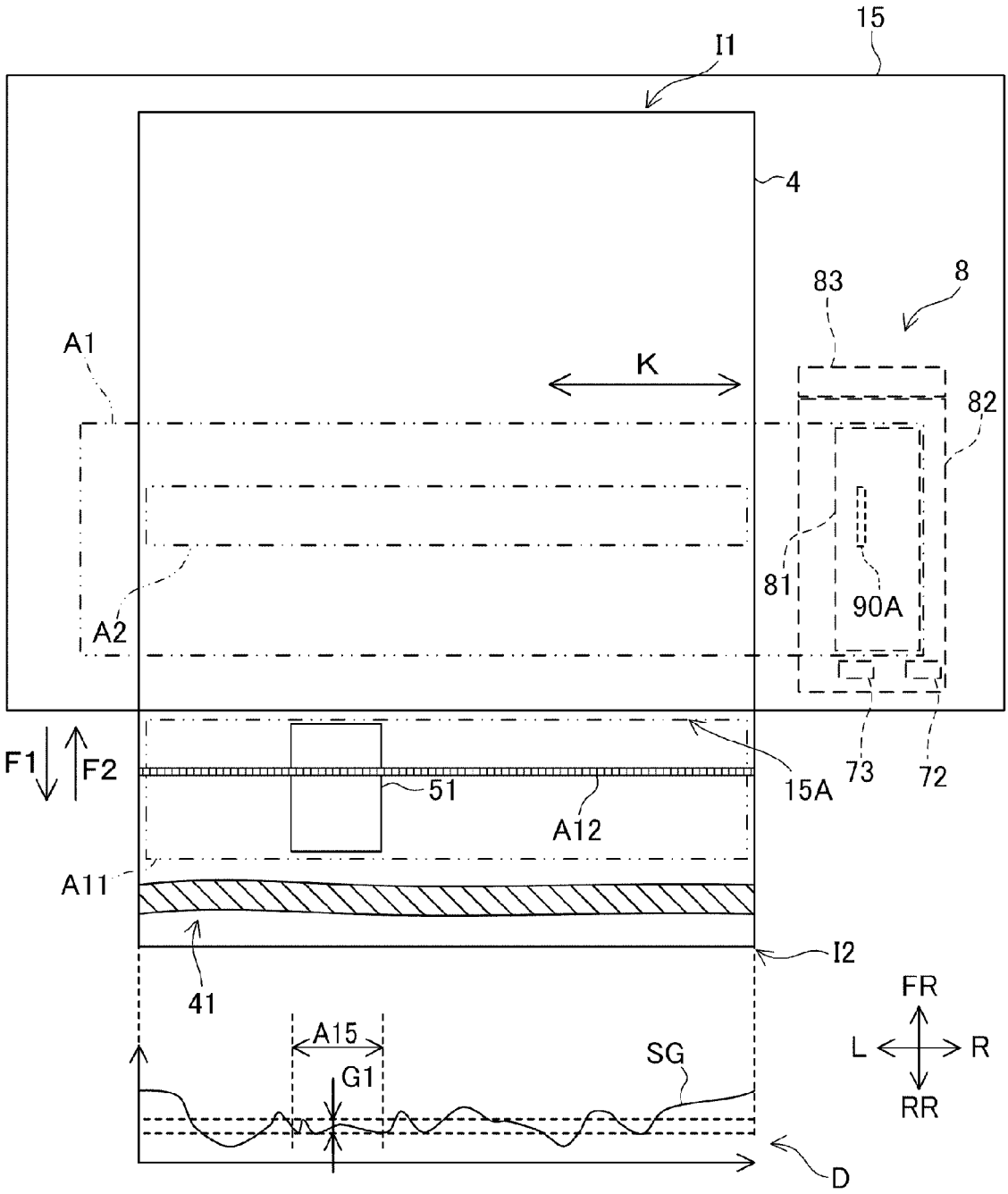
FIG. 7 is a plan view of an essential portion of a printer according to a second embodiment.

FIG. 7 is a plan view of an essential portion of a printer 1 according to a second embodiment, and a graph of a detection result of a belt sensor 73 is additionally illustrated.

A configuration of the printer 1 according to the second embodiment is the same as the first embodiment. In the second embodiment, an operation of detecting a height of a viscosity surface of a transport belt 4 using the belt sensor 73 and using the detected height in adjustment of an alignment shift which is performed by the printer 1 will be described as an example.

The belt sensor 73 emits light to the transport belt 4 beneath a carriage 82 and detects reflection light so as to detect a distance between the belt sensor 73 and the transport belt 4. The carriage 82 may perform scanning in a constant height along a guide, not illustrated, described above. Therefore, a distance detected by the belt sensor 73 indicates a change in the height of the surface of the transport belt 4.

It is assumed that the belt sensor 73 performs detection in a region indicated by a reference symbol A12 in FIG. 7. A region to be detected A12 extends in a scanning direction K, and the belt sensor 73 performs detection on the region to be detected A12 while being moved in the scanning direction K. When a detection value of the belt sensor 73 is associated with a position in the scanning direction K, a distribution SG of heights of the transport belt 4 in the scanning direction K is obtained as indicated by a reference character D in FIG. 7.

A flatness degree of the transport belt 4 may be different depending on a position in the belt movement direction F1. Therefore, the region to be detected A12 is preferably included in a test medium set region A11 set in advance.

When a change in the height of the transport belt 4 is small in the position where the test medium 51 is set, distortion of the test medium 51 is small, and therefore, an alignment shift may be detected with higher accuracy. Therefore, the printer 1 selects a region in which a change in height of the transport belt 4 is small in the detected region A12, that is, a region of high flatness degree in the transport belt 4, in accordance with a result of the detection of the height of the transport belt 4 in the detected region A12 and determines the region as a position where the test medium 51 is to be mounted. This region is referred to as a test medium set region A15. A size of the test medium set region A15 in the scanning direction K is set in accordance with a size of the test medium 51 in a width direction. In the test medium set region A15, a height range G1 of the transport belt 4 is smaller than the other portions in the detected region A12 and a high flatness degree is attained.

In this way, the printer 1 sets the test medium set region A15 having a high flatness degree of the transport belt 4 in accordance with the result of the detection using the belt sensor 73 in the test medium set region A11. By this, an alignment shift of the print heads 90 may be examined with higher accuracy.

Figure 8:
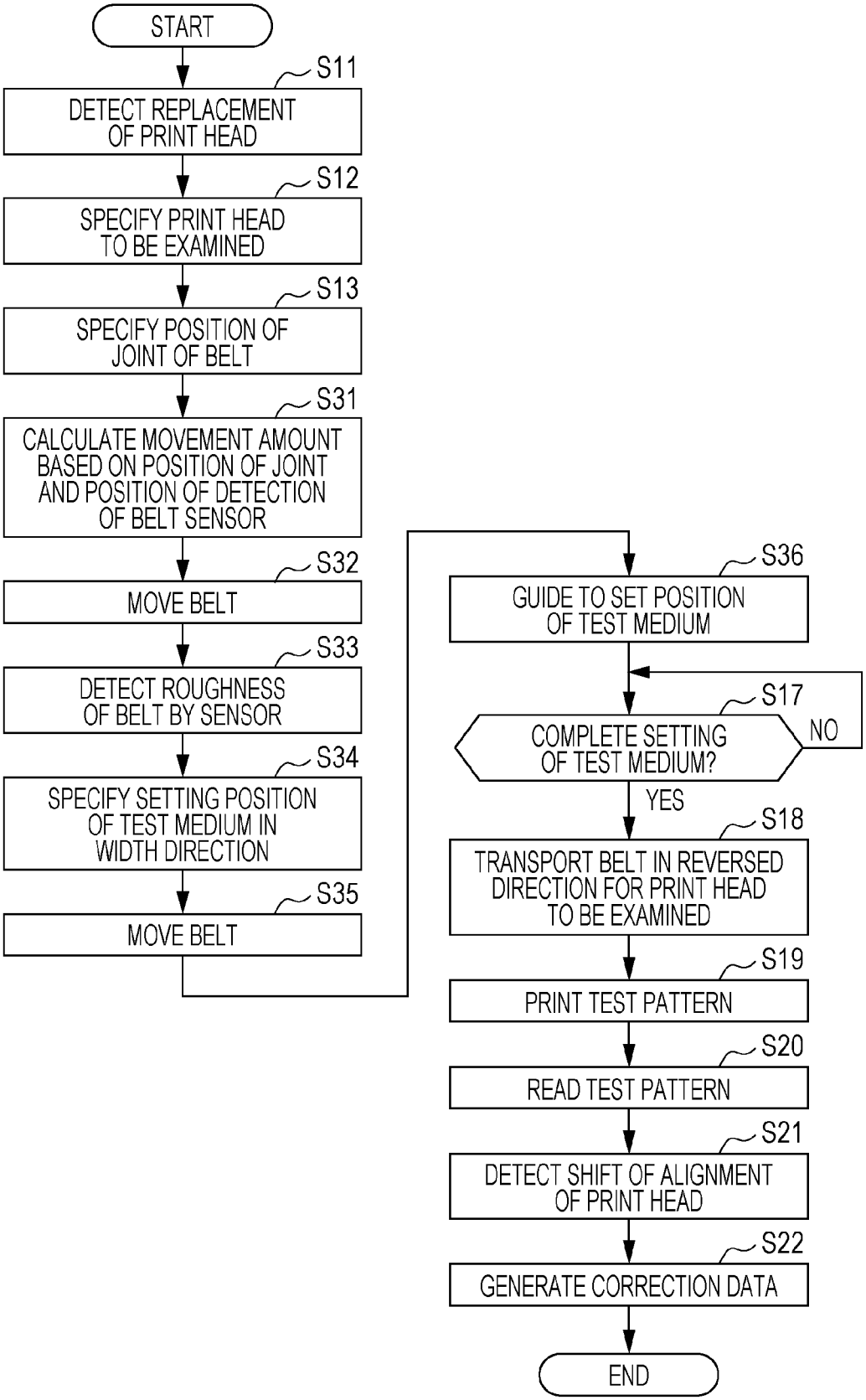
FIG. 8 is a flowchart of an operation of the printer according to the second embodiment.

FIG. 8 is a flowchart of an operation of the printer 1 according to the second embodiment. In FIG. 8, the same step numbers are assigned to processes the same as those of the operations of the first embodiment illustrated in FIG. 6 and descriptions thereof are omitted. In the operation illustrated in FIG. 8, step S31 and step S34 correspond to operations of the print controller 112, and step S32 and step S35 correspond to operations of the driving controller 113. Step S33 corresponds to an operation of the detection controller 115, and step S36 corresponds to an operation of the display controller 114.

After a position of the joint 41 is specified in step S13, the controller 100 calculates a movement amount of the transport belt 4 based on a position of the joint 41 and a detection position of the belt sensor 73 (step S31). Specifically, the test medium set region A11 is set in a position shifted from the joint 41 and a movement amount of the transport belt 4 is calculated such that the test medium set region A11 is positioned beneath the belt sensor 73 (step S31).

The controller 100 rotates the transport motor 141 in a normal direction based on the movement amount calculated in step S31 so as to move the transport belt 4 in the belt movement direction F1 (step S32). In step S32, the controller 100 may rotate the transport motor 141 in a reversed direction so as to move the transport belt 4 in the belt movement direction F2.

The controller 100 causes the carriage 82 to perform scanning so that the belt sensor 73 detects the detected region A12 and obtains a result of the detection (step S33). The result of the detection obtained in step S33 is associated with a position of the carriage 82 detected by the linear encoder 152 so that a height distribution SG is obtained.

The controller 100 specifies the test medium set region A15 based on the detection result obtained in step S33 and a size of the test medium 51 set in advance (step S34). The controller 100 stores a position of the test medium set region A15 in the storage section 120 as a portion of the setting data 122.

The controller 100 drives the transport motor 141 so that the test medium set region A11 including the detected region A12 reaches a position where the test medium 51 is set by an operator and moves the transport belt 4 (step S35). For example, the test medium set region A11 moves the transport belt 4 until the transport belt 4 reaches the rear end portion 15A.

The controller 100 guides the test medium set region A15 specified in step S34 for the operator (step S36). For example, the controller 100 causes the display 183 to display a screen guiding the position of the test medium 51.

Figure 9:
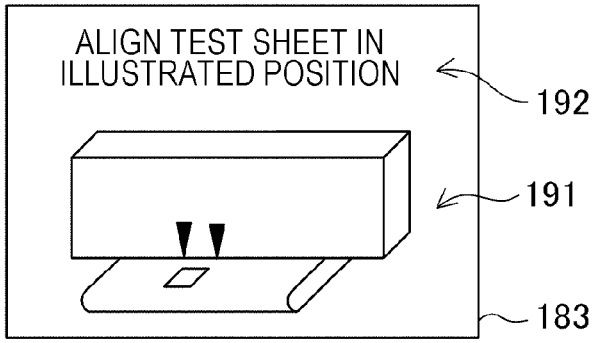
FIG. 9 is a diagram of a display example of a display according to the second embodiment.

FIG. 9 is a diagram of a display example of the display 183 according to the second embodiment.

In the display example of FIG. 9, appearance of the printer 1 and a guide image 191 indicating a set position of the test medium 51 in the printer 1 are displayed. Furthermore, a message 192 guiding that the test medium 51 is to be set in a position indicated by the guide image 191 is displayed for the operator. In this case, the display 183 corresponds to an example of a position indication section according to the present disclosure.

The controller 100 determines whether the test medium 51 has been mounted on the test medium set region A11 by the operator (step S17) and waits until the test medium 51 is mounted (step S17; NO). When the setting of the test medium 51 is completed (step S17; YES), the controller 100 reversely rotates the transport motor 141 so as to move the transport belt 4 in the belt movement direction F2 and transports the test medium 51 (step S18). In step S18, the test medium 51 is transported to the print region A2 which is a print position of the print head 90 to be examined. Thereafter, as with the operation illustrated with reference to FIG. 6, the controller 100 causes the print head 90 to print a test pattern, causes the scan unit 72 to read the printed test pattern, and generates head correction data 127.

According to the printer 1 of the second embodiment to which the present disclosure is applied, operation effects of the first embodiment are obtained.

Furthermore, the printer 1 includes the carriage 82 which performs scanning in a direction intersecting with the belt movement directions F1 and F2 of the transport belt 4 and the belt sensor 73 which is mounted on the carriage 82 and which detects a distance between a reference position and a surface of the belt. The driving controller 113 specifies the test medium set region A15 which satisfies a condition in which a flatness degree of the transport belt 4 is set based on the detection result of the belt sensor 73 obtained while the carriage 82 is performing scanning. Accordingly, since the position of the test medium 51 is determined while a state of the transport belt 4 obtained when the print head 90 is adjusted is reflected, the print head 90 may be adjusted with higher accuracy.

The foregoing embodiments are concrete examples to which the present disclosure is applied and the present disclosure is not limited to these.

For example, when the operation of the first embodiment described above is performed, it is not necessarily the case that the printer 1 includes the belt sensor 73 and the belt sensor 73 may be omitted.

Furthermore, although the printer 1 includes the ink ejection unit 81 having the plurality of print heads 90 according to the first and second embodiments, the present disclosure is not limited to this and the present disclosure may be applied to a print apparatus including a single print head 90.

Furthermore, in the second embodiment, a method for guiding a position of the test medium set region A15 for the operator is not limited to display by the display 183. For example, a display screen and a light emitting diode (LED) indicator may be disposed on a surface of the exterior package 15 near the rear end portion 15A so that a position of the test medium 51 may be guided by display of the display screen and the LED indicator. Furthermore, data indicating a position of the test medium set region A15 may be transmitted from the printer 1 to another computer installed in a position far away from the printer 1. In this case, the other computer which has received the data from the printer 1 may display a screen for guiding the position of the test medium 51.

Although the printer 1 which prints an image by transporting the rolled print medium W is taken as an example in the foregoing embodiments, the present disclosure is not limited to this. The present disclosure may be applied to a print apparatus which performs printing by holding the print medium W, such as fabric, to be printed in a fixed manner and causing the ink ejection unit 81 to be moved relative to the print medium W. The present disclosure may be applied to a so-called garment printer which fixes cloth or sewing fabric as the print medium W and performs printing by ejecting ink to the print medium W. Furthermore, the present disclosure may be applied to the print apparatus performing printing on not only fabric but also knit fabric, paper, a sheet of synthetic resin.

Furthermore, the present disclosure may be applied not only an apparatus solely used as a print apparatus but also an apparatus having functions in addition to a print function, such as a multifunction peripheral having a copy function and a scan function and a POS terminal apparatus.

Furthermore, the printer 1 may be an apparatus using the ink IK which is hardened by irradiation with ultraviolet light, and in this case, the printer 1 may include an ultraviolet irradiation device instead of the dry unit 9. Furthermore, the printer 1 may include a cleaning device cleaning the print medium W dried by the dry unit 9, and detailed configuration of the printer 1 may be arbitrarily changed.

Furthermore, the functional sections included in the controller 100 may be configured as the control programs 121 to be executed by the processor 110 as described above, and may be realized by hardware circuits incorporating the control programs 121 therein. Moreover, the control programs 121 may be received by the printer 1 from a server apparatus or the like through a transmission medium.

Furthermore, the functions of the controller 100 may be realized by a plurality of processors or semiconductor chips.

Furthermore, the steps of the operations illustrated in FIGS. 6 and 8 are obtained by dividing the operation according to main processing content, and the present disclosure is not limited by a method for dividing processing units and names of the processing units. The operations may be divided into a larger number of step units in accordance with processing content. Furthermore, the operations may be divided such that one of the step units includes a larger number of processes. Moreover, order of the steps may be changed where appropriate within the scope of the present disclosure.

What is claimed is:

1. A print apparatus comprising:

a print head ejecting ink to a print medium;

a belt on which the print medium is mounted;

a driving section configured to transport the print medium by moving the belt;

a specifying section configured to specify the print head to be adjusted using a test pattern;

a position indication section configured to instruct a position of the print medium when the test pattern is printed on the print medium; and a driving controller configured to control the driving section, wherein the driving controller adjusts a position of the print medium by controlling the driving section relative to the print head to be adjusted specified by the specifying section, wherein the print head is configured to perform printing on a first print medium for image printing and a second print medium which is the print medium on which the test pattern is to be printed and which is different from the first print medium, wherein the driving controller moves the belt in a first direction so as to transport the first print medium when the print head prints an image on the first print medium, and wherein the belt is moved in a second direction which is different from the first direction when the second print medium is moved to a position of the print head specified by the specifying section so that the test pattern is printed.

2. The print apparatus according to claim 1, further comprising:

a pattern detection section configured to detect the test pattern printed on the print medium, wherein the driving controller detects a shift of alignment of the print head based on a result of detection performed by the pattern detection section.

3. The print apparatus according to claim 1, further comprising:

a plurality of print heads, wherein the specifying section specifies a replaced head in the print heads as a print head to be adjusted.

4. The print apparatus according to claim 1, wherein a position specified by the position indication section is in a downstream of the print head in the first direction.

5. The print apparatus according to claim 1, wherein the second print apparatus is a cut sheet of a regular size and a shift of alignment of the print head is detected by optically reading the test pattern printed on the second print medium.

6. The print apparatus according to claim 1, wherein the belt is processed in an endless shaped by coupling opposite sides of a long belt member, and wherein the driving controller moves the belt before the print medium is mounted, when a joint section of the belt is positioned in a predetermined range from a position specified by the position indication section.

7. The print apparatus according to claim 1, further comprising:

a carriage configured to perform scanning in a direction intersecting with a movement direction of the belt, the print head being mounted on the carriage; and a distance detection section configured to be mounted on the carriage and detect a distance from a reference position to a surface of the belt, wherein the driving controller specifies a region in which a flatness degree of the belt satisfies a set condition based on a result of detection performed by the distance detection section during scanning of the carriage.

8. A method for controlling a print apparatus which includes a print head ejecting ink to a print medium and a belt on which the print medium is mounted and which transports the print medium by moving the belt, the method comprising:

moving, when the print head to be adjusted using a test pattern is specified, the belt in accordance with the specified print head to be adjusted so that a position of the print medium is adjusted, wherein the print head is configured to perform printing on a first print medium for image printing and a second print medium which is the print medium on which the test pattern is to be printed and which is different from the first print medium, wherein the driving controller moves the belt in a first direction so as to transport the first print medium when the print head prints an image on the first print medium, and wherein the belt is moved in a second direction which is different from the first direction when the second print medium is moved to a position of the print head specified by the specifying section so that the test pattern is printed.

9. A non-transitory computer-readable storage medium storing a control program to be executed by a controller controlling a print apparatus which includes a print head ejecting ink to a print medium and a belt on which the print medium is mounted and which transports the print medium by moving the belt, the program, when executed by the controller, causing the print apparatus to:

move, when the print head to be adjusted using a test pattern is specified, the belt in accordance with the specified print head to be adjusted so that a position of the print medium is adjusted, wherein the print head is configured to perform printing on a first print medium for image printing and a second print medium which is the print medium on which the test pattern is to be printed and which is different from the first print medium, wherein the driving controller moves the belt in a first direction so as to transport the first print medium when the print head prints an image on the first print medium, and wherein the belt is moved in a second direction which is different from the first direction when the second print medium is moved to a position of the print head specified by the specifying section so that the test pattern is printed.

* * * * *